United States Patent [19]

Sacco et al.

[11] Patent Number: 5,009,042

[45] Date of Patent: Apr. 23, 1991

[54] MODULAR DISPLAY SYSTEM

[75] Inventors: Bruno Sacco; Johann Tomforde, both of Sindelfingen; Thomas Abb, Klingenberg; Bruno Stenemann, Beckum, all of Fed. Rep. of Germany

[73] Assignee: Daimler-Benz AG

[21] Appl. No.: 443,040

[22] Filed: Nov. 30, 1989

Related U.S. Application Data

[63] Continuation of Ser. No. 241,267, Sep. 7, 1988, abandoned.

[30] Foreign Application Priority Data

Sep. 7, 1987 [DE] Fed. Rep. of Germany ..... 3729903

[51] Int. Cl.[5] ..... E04B 2/00; E04H 1/00

[52] U.S. Cl. ..... 52/36; 52/239; 52/282; 211/187; 211/208

[58] Field of Search ..... 52/36, 238.1, 239, 281, 52/282; 211/187, 208

[56] References Cited

U.S. PATENT DOCUMENTS

| | | | |
|---|---|---|---|
| 3,166,285 | 1/1965 | Downes | 52/36 |
| 3,189,140 | 6/1965 | Luss | 52/36 |
| 3,521,047 | 7/1970 | Smith | 52/282 |
| 3,566,561 | 3/1971 | Tozer | 52/282 |
| 3,861,101 | 1/1975 | Whisson | 52/238.1 |
| 3,892,189 | 7/1975 | Killam | 52/36 |
| 3,901,164 | 8/1975 | Urti | 52/281 |
| 4,291,928 | 9/1981 | Kiyosawa | 211/187 |
| 4,625,483 | 12/1986 | Zacky et al. | 52/239 |
| 4,631,881 | 12/1986 | Charman | 52/238.1 |

FOREIGN PATENT DOCUMENTS

| | | | |
|---|---|---|---|
| 212996 | 3/1987 | European Pat. Off. | 211/208 |
| 2103502 | 12/1972 | Fed. Rep. of Germany | 52/282 |
| 2241061 | 2/1974 | Fed. Rep. of Germany | 52/282 |
| 2039207 | 1/1971 | France | 52/36 |
| 2390924 | 1/1979 | France | 52/36 |
| 8703321 | 6/1987 | PCT Int'l Appl. | 52/239 |
| 783183 | 9/1957 | United Kingdom | 52/281 |
| 2060022 | 4/1981 | United Kingdom | 52/36 |

*Primary Examiner*—Michael Safavi

*Attorney, Agent, or Firm*—Evenson, Wands, Edwards, Lenahan & McKeown

[57] ABSTRACT

A modular display system is disclosed which exhibits wall elements having vertical interior profiles arranged in the lateral corner regions. The vertical profiles are connectable among themselves by horizontally oriented profiles, and the face side of which exhibits a covering. In order to render such a system particularlly versatile for demounting and use, it is provided according to the invention that the vertical profiles exhibit, in addition to a first contact surface oriented at right angles to the extension of the wall element for the horizontal profiles, a second contact surface oriented in the direction of extension of the wall element for accommodating connection of identical profiles oriented transversely to the latter. Exterior formally rigid covering parts are attachable to the profiles oriented in the direction of extension of the wall element. The vertical profiles exhibit outwards adjacently to the second contact surface a housing channel oriented in the direction of extension of the profile. Guide strips opening inwards protrude from the member region of the vertical profile which connects the first and second contact surfaces.

3 Claims, 5 Drawing Sheets

MODULAR DISPLAY SYSTEM

This is a continuation, of application Ser. No. 07/241,267, filed Sept. 7, 1988 now abandoned.

BACKGROUND AND SUMMARY OF THE INVENTION

The invention relates to a modular display system which exhibits wall elements having vertical interior profiles arranged in the lateral corner regions, which are connectable among themselves by horizontally oriented profiles, and the face side of which exhibits a covering.

Wall elements constructed in such manner are already known from room dividers.

An underlying object of the present invention, starting from wall elements of the above-noted general type, is to develop a modular display system versatile in use and in demounting.

This object is achieved according to the invention by the vertical profiles exhibiting, in addition to a first contact surface oriented at right angles to the extension of the wall element for the horizontal profiles, a second contact surface oriented in the direction of extension of the wall element for accommodating attachment of similar profiles oriented transversely to the latter. Exterior formally rigid covering parts are attachable to the profiles oriented in the direction of extension of the wall element. The vertical profiles exhibit, outwards adjacently to the second contact surface, a housing channel oriented in the direction of extension of the profile, and guide strips open inwards protruding from the member region of the vertical profile which connects the first and second contact surfaces.

Other objects, advantages and novel features of the present invention will become apparent from the following detailed description of the invention when considered in conjunction with the accompanying drawings.

DETAILED DESCRIPTION OF THE DRAWINGS

Figure 1:
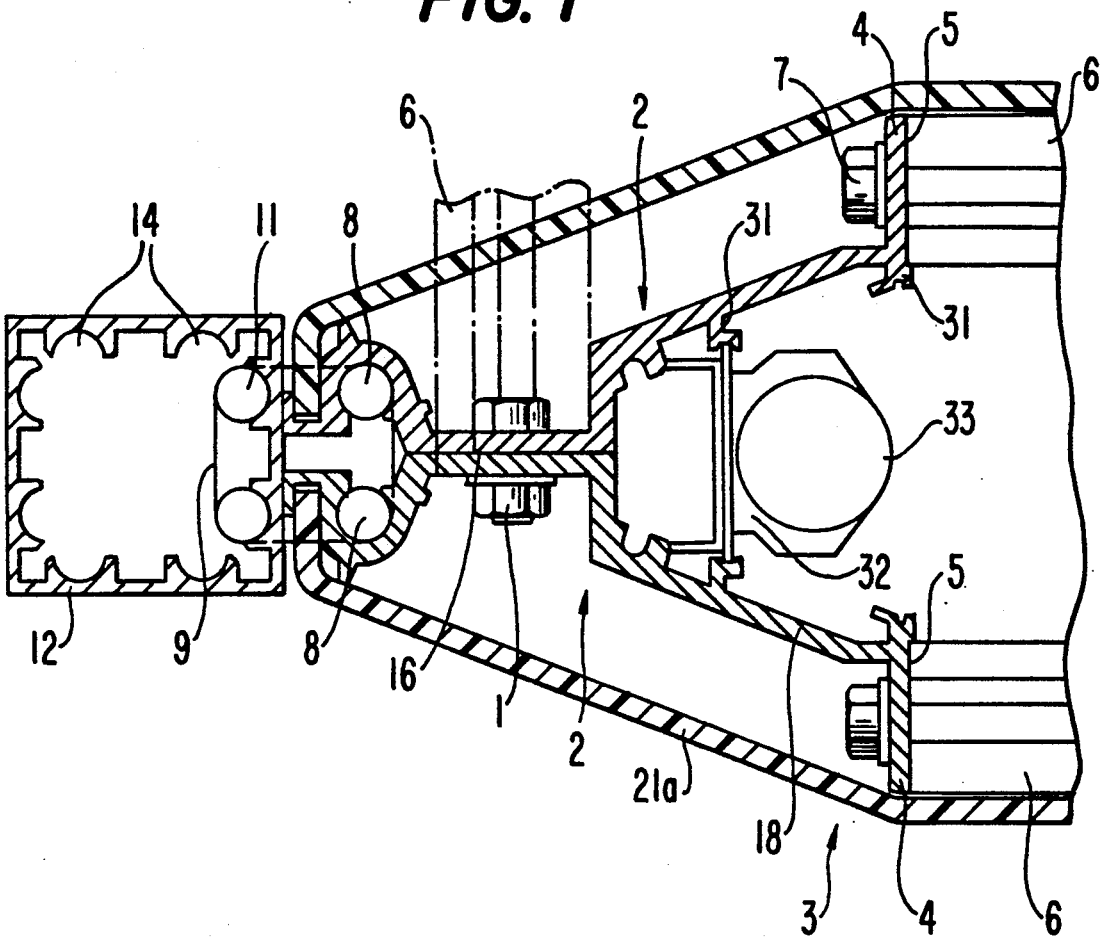
FIG. 1 shows a horizontal section view through two mutually connected vertical profiles in the corner region of a wall element constructed according to a preferred embodiment of the present invention.

FIG. 1 of the drawings shows two vertical profiles 2 held together in mirror image relationship by a screw 1, which form a part of the supporting structure of a wall element 3. On a member 4 protruding outwards, the profiles 2 exhibit first contact surfaces 5 for horizontally oriented profiles 6, which are connected to the member 4 by a screw connection 7. The horizontal profiles 6 extend as far as the other end region, not shown, of the wall element 3 and are likewise screwed to vertical profiles 2 there. The cross-sectional shape of the horizontal profiles 6 may be seen from FIG. 8 of the drawing, wherein bolt holes 7A for the screw connection 7 are depicted.

Figure 2:
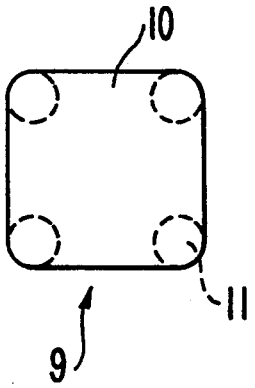
FIG. 2 is a plan view of a plug-like connecting element for connecting wall elements with vertical profiles according to FIG. 1 to one another.
Figure 3:
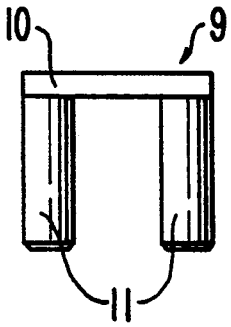
FIG. 3 is a side elevation of this connecting element of FIG. 2.

In their left-hand end regions (in FIG. 1) the profiles 2 respectively exhibit a partially open housing channel 8 of circular cross-section oriented in the direction of extension of the profile. These housing channels 8 serve for fastening a plurality of wall elements 3 together. This is effected by plug-like connecting elements 9, illustrated in FIGS. 2 and 3, in which four circular pins 11, the external diameter of which is adapted to the shape of the housing channels 8, protrude from a base plate 10.

Now if only two mutually adjacent and mutually aligned wall elements 3 are to be connected, then it is only necessary for respective connecting elements 9 to be introduced by its pins 11 into the associated housing channels 8 at the top and/or the bottom.

Figure 4:
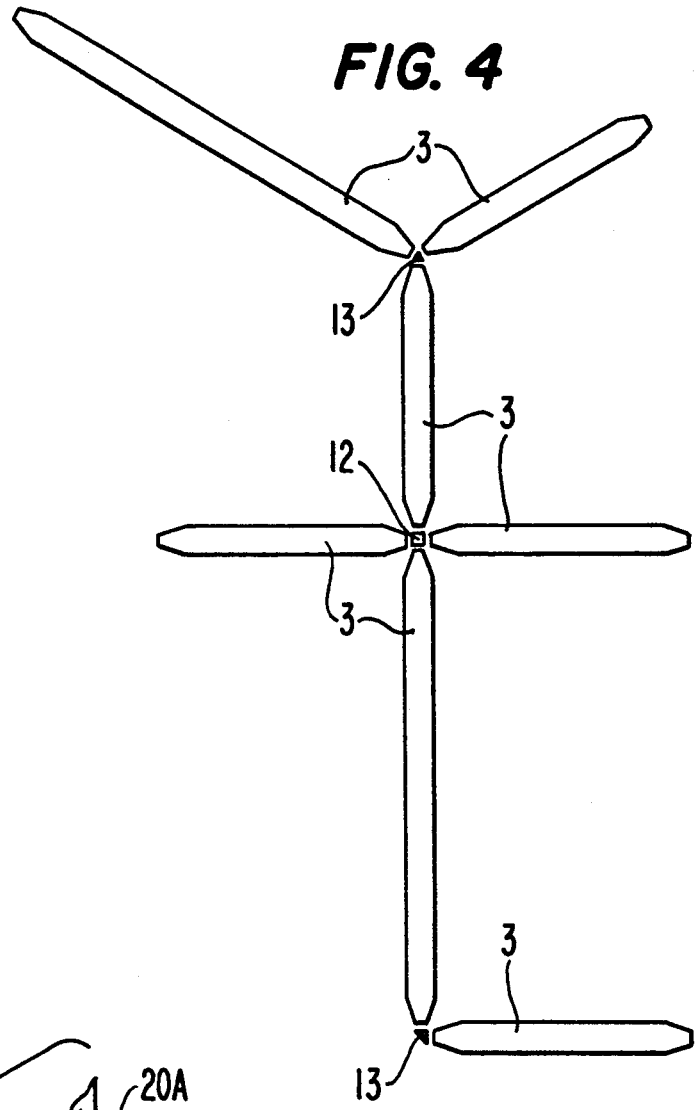
FIG. 4 is a plan view schematically depicting possible variants of erection of wall elements utilizing preferred embodiments of the present invention.
Figure 5:
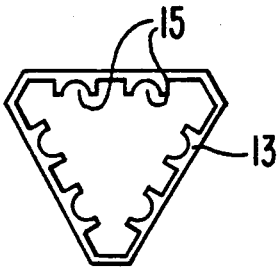
FIG. 5 shows a section through a triangular hollow profile serving as an intermediate piece, constructed according to another preferred embodiment of the invention.

However, in case it is required to attach a further wall element, which is not aligned with the first, or a plurality of wall elements to one side of a wall element 3, such as shown in FIG. 4 of the drawing, intermediate pieces 12 (FIG. 1) or 13 (FIG. 5) are provided for the connection, which likewise exhibit on their interior surface partly open circular guide channels 14 or 15 to receive pins 11 by pairs in each case.

It should be stated with reference to the profiles 2 that the use of two profiles screwed together in mirror image relationship is only necessary when it is required to produce a free-standing wall element. If it is required to produce a "half" wall element so to speak, which is required to be screwed to a building wall for example, one profile 2 is sufficient and the screw 1 may then serve for the wall fixing of the "half" wall element.

Figure 10:
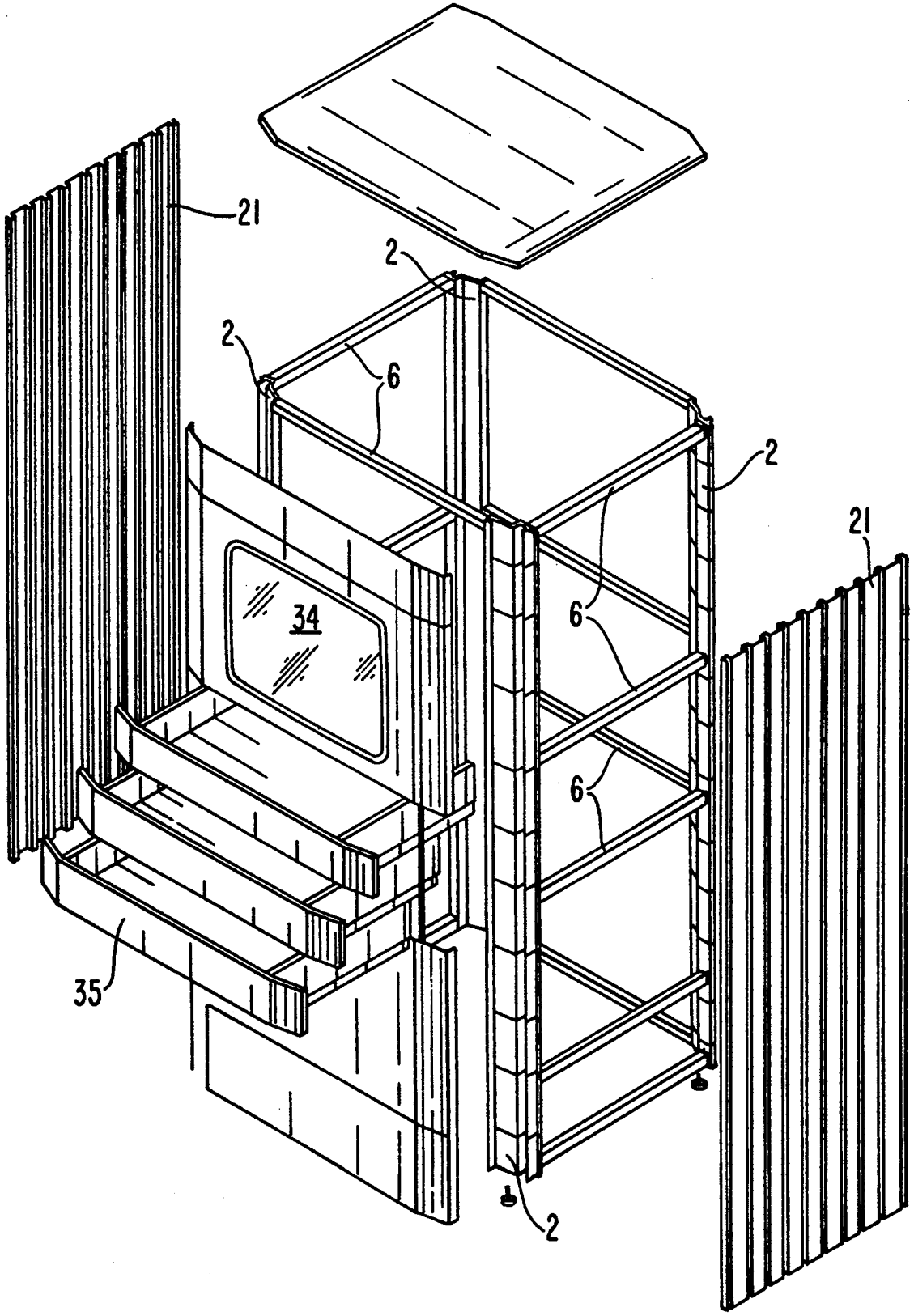
FIG. 10 shows diagrammatically a perspective exploded view of a video tower assembled from elements constructed according to preferred embodiments of the present invention.

It is furthermore contemplated to use the second contact surface 16 of the lower profile 2 in FIG. 1 as a contact surface for horizontal profiles 6 (FIG. 1) oriented transversely to the direction of extension of the wall element 3, which could then be fixed by the screw 1, so as to produce the supporting structure for a video tower shown in FIG. 10 or the like, for example.

Figure 6:
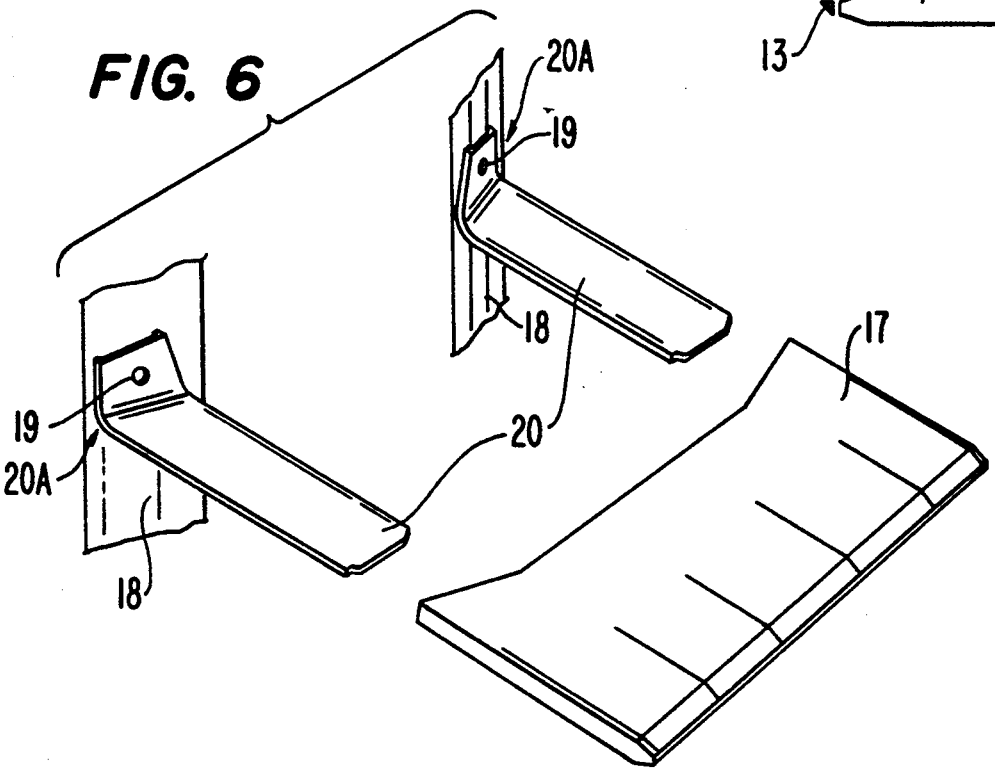
FIG. 6 is a diagrammatic view depicting a configuration for fastening of shelves slidable on from the outside, utilizing a preferred embodiment of the present invention.
Figure 7:
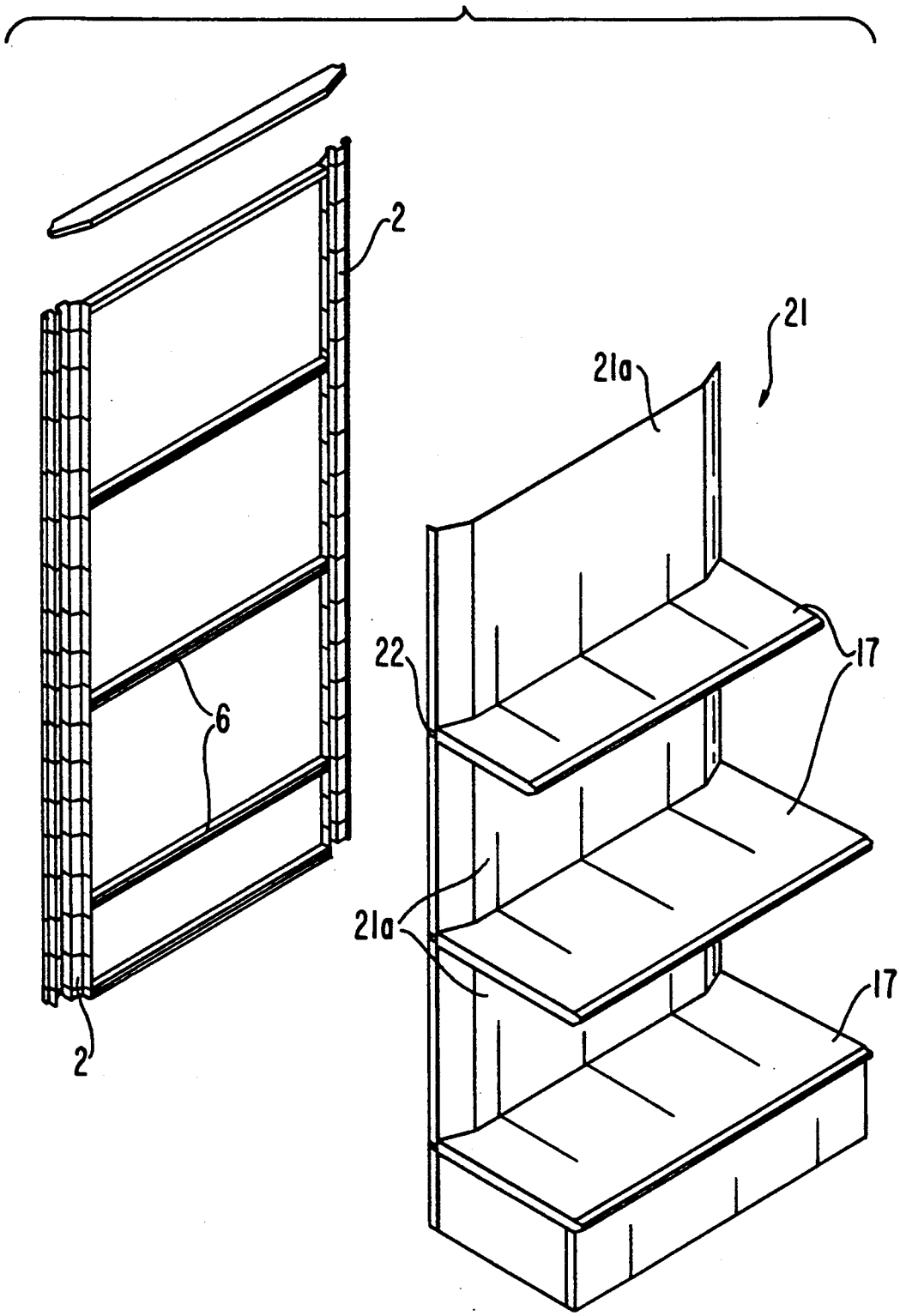
FIG. 7 is a perspective exploded view of a wall element with shelves constructed according to a preferred embodiment of the invention.

Exterior shelves 17 may also be attached to the wall elements 3 according to the invention in a simple manner, as is shown in FIGS. 6 and 7 of the drawing. For this purpose a member region 18 oriented obliquely between the contact surfaces 16 and 5 of the profile 2 exhibits bores 19 provided with a screw thread, so that stirrups 20 can be fastened by a screw connection 20A, onto which stirrups 20 the shelves 17, which exhibit internal guide channels, can simply be pushed.

The outer covering 21 consists here of individual segments 21*a* arranged superposed at a mutual interval, with the stirrups 20 extending into gaps 22.

Figure 8:
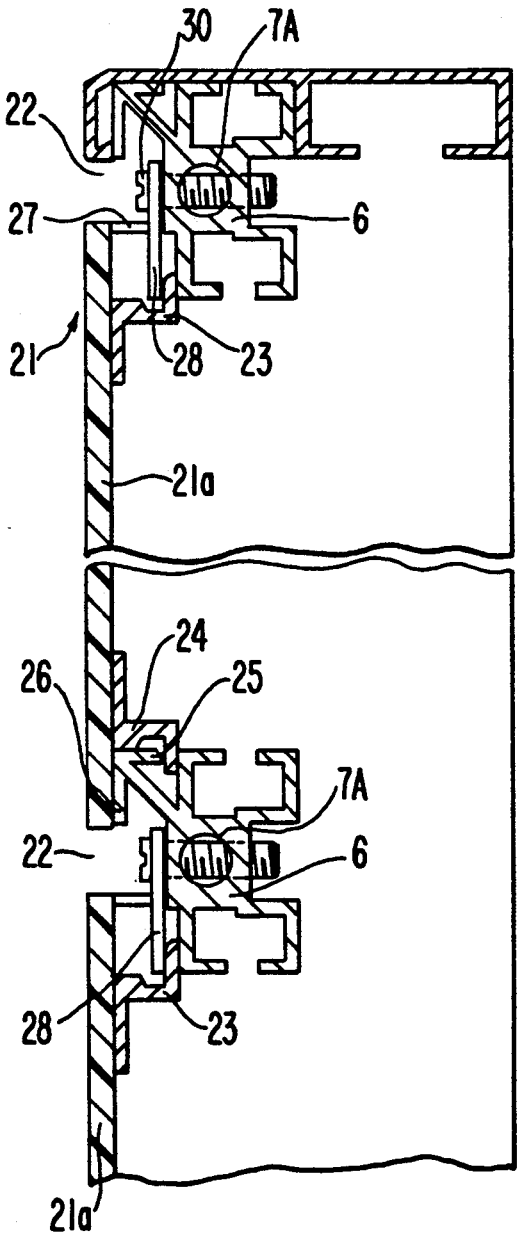
FIG. 8 shows in a vertical sectional view, the fastening of formally rigid covering parts to the horizontal profiles oriented in the direction of extension of the wall element constructed according to preferred embodiments of the invention.
Figure 9:
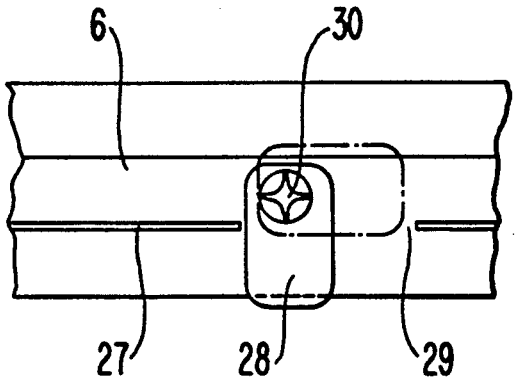
FIG. 9 schematically shows a locking means for such a fastening means as dePicted in FIG. 8.

The fastening of a segment 21*a* of the covering 21 to the horizontal profiles 6 is shown in FIGS. 8 and 9 of the drawing. For this purpose the segments 21*a* are each provided on their rear side with angles 23 and 24 pointing upwards and downwards. For fastening the lower angle 24 is pushed behind a member 25 of the profile 6, when the segment 21*a* comes into contact beneath on a front member 26 of the profile 6 and above a member 27 of the profile 6. Locking is then effected with a hasp 28 which engages behind the angle 23, and for the movement of which the member 27 exhibits local recesses (at 29). The twisting of the hasp 28 is effected by rotating a cross-head screw 30 which is accessible for a screwdriver through the gap 22.

Lastly, the vertical profiles 2 are provided on the rear side of their member region 18 with inwardly open protruding guide strips 31 with U-shaped end regions, into which holder elements 32 for florescent tubes 33 are inserted.

Although the present invention has been described and illustrated in detail, it is to be clearly understood that the same is by way of illustration and example only, and is not to be taken by way of limitation. The spirit and scope of the present invention are to be limited only by the terms of the appended claims.

We claim:

1. A modular display comprising:

a wall element having vertical interior profiles arranged at lateral corner regions of the wall element and a horizontal elongated, profile extending between the vertical profiles;

a first contact surface of each of the vertical profiles for contacting the horizontal profile, the first contact surface extending at a right angle to a longitudinal axis of the horizontal profile;

a second contact surface of each of the vertical profiles for contacting one of an additional horizontal profile and a mirror inverted vertical profile for forming a free standing wall, the second contact surface extending parallel to the longitudinal axis of the horizontal profile;

a housing channel of the vertical profiles facing outwardly from the wall element and extending in a longitudinal direction of the vertical profiles; and a rigid covering for attaching to the horizontal and vertical profiles to form an exterior of the wall element, wherein the rigid covering is formed by segments arranged superposed at a mutual interval, and wherein stirrups, which are respectively attachable to a mid-region of each of the vertical profiles positioned between the first and second contact surfaces of each of the vertical profiles, pass through a gap present between the segments and are slidable on shelves attached to the wall element which each have at least one interior guide channel for this purpose.

2. A modular display system comprising:

a wall element having vertical interior profiles arranged at lateral corner regions of the wall element and a horizontal elongated, profile extending between the vertical profiles;

a first contact surface of each of the vertical profiles for contacting the horizontal profile, the first contact surface extending at a right angle to a longitudinal axis of the horizontal profile;

a second contact surface of each of the vertical profiles for contacting one of an additional horizontal profile and a mirror inverted vertical profile for forming a free standing wall, the second contact surface extending parallel to the longitudinal axis of the horizontal profile;

a housing channel of the vertical profiles facing outwardly from the wall element and extending in a longitudinal direction of the vertical profiles;

a rigid covering for attaching to the horizontal and vertical profiles to form an exterior of the wall element;

a plug-like connecting element having four pins protruding symmetrically from a base plate for connecting a plurality of wall elements, the pins of the connecting elements being respectively introducible into the housing channels of the vertical profiles for the connection of two mutually aligned wall elements, wherein two identical vertical profiles are connectable together in mirror image relationship at their second contact surfaces by threaded connection means, the rigid covering is formed by segments arranged superposed at a mutual interval, and stirrups, which are respectively attachable to a mid-region of each of the vertical profiles positioned between the first and second contact surfaces of each of the vertical profiles, pass through a gap present between the segments and are slidable on shelves which each have at least one interior guide channel for this purpose.

3. Display system according to claim 2, wherein two wall elements which are arranged mutually parallel at an interval are mutually connected by a horizontal profile, and wherein installation or attachment elements, such as video screens, drawers or the like are arranged in at least one wall defined by the horizontal profile.

* * * * *